US005203381A

United States Patent [19]

Froment et al.

[11] Patent Number: 5,203,381

[45] Date of Patent: Apr. 20, 1993

[54] SPRING TENSION RELIEVING DEVICE FOR NEGATIVE DOBBY

[75] Inventors: Jean-Paul Froment; André Fumex, both of Faverges, France

[73] Assignee: S.A. des Etablissements Staubli, Faverges, France

[21] Appl. No.: 824,398

[22] Filed: Jan. 23, 1992

[30] Foreign Application Priority Data

Jan. 25, 1991 [FR] France ..... 9101065

[51] Int. Cl.[5] ..... D03C 1/14

[52] U.S. Cl. ..... 139/84; 139/88; 139/89

[58] Field of Search ..... 139/84, 89, 88, 91, 139/82

[56] References Cited

U.S. PATENT DOCUMENTS

| | | | |
|---|---|---|---|
| 2,250,412 | 7/1941 | Brown | 139/84 |
| 4,687,029 | 8/1987 | Takada | 139/89 |
| 4,877,060 | 10/1989 | Froment et al. | 139/88 X |
| 4,905,739 | 3/1990 | Froment | 139/89 X |
| 4,957,142 | 9/1990 | Houlon | 139/88 |

*Primary Examiner*—Andrew M. Falik
*Attorney, Agent, or Firm*—Dowell & Dowell

[57] ABSTRACT

A drawing device for actuating the heddle frames of a weaving machine of the negative type including rocking levers which guide cables extending from the heddle frame to a return spring system. The rocking levers are mounted on shafts which are shiftable within elongated slots to thereby relax tension on the cables and spring system.

9 Claims, 4 Drawing Sheets

SPRING TENSION RELIEVING DEVICE FOR NEGATIVE DOBBY

BACKGROUND OF THE INVENTION

1. Field of the Invention

The present invention relates to dobbies and other weaving mechanisms of the negative type and more particularly to the drawing device interposed between each of the members for maneuvring the mechanisms and a corresponding heddle frame mounted on the associated weaving machine.

2. History of the Related Art

It is known that a weaving mechanism of the negative type ensures positive control of the frames only in one direction of their reciprocating stroke, with the result that it is necessary to provide elastic elements which are placed in tension during positive actuation so as to effect the return of each frame as soon as the corresponding maneuvring member of the mechanism ceases its action.

In practice, these elastic elements are spring systems including a plurality of springs maintained between two hooking elements. One of the hooking elements is suitably fastened to the fixed structure of the weaving machine, while the other is secured either with the end of a control cable coupled to each heddle frame, or with a rocking guide lever disposed along path of the cable between the frame and the spring system.

It should be observed that, to allow the weaving machines to operate at very high speeds, there is a tendency, at present, to employ increasingly powerful spring systems, which results in both the springs of the systems and the control cables breaking more frequently. Now, it is difficult to repair these operational failures, as this involves dismantling and subsequent remounting a large number of springs on which a very high tension is exerted.

SUMMARY OF THE INVENTION

It is an object of the present invention to overcome this drawback by providing a drawing device for the actuation of heddle frames of the weaving mechanisms of the negative type, which includes at least one control cable which is laterally fixed to the frame and of which one end is attached to one of the members for maneuvring the mechanism, while the opposite end is associated with a spring system after being guided by a lever mounted to oscillate on a support shaft carried by the fixed structures of the weaving machine. The support shaft is engaged inside guiding slideways with which are associated actuation elements arranged to cause its transverse displacement in the slideways and subsequently the momentary relaxing of tension on the assembly of spring systems and cables so that repair may be made thereto.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
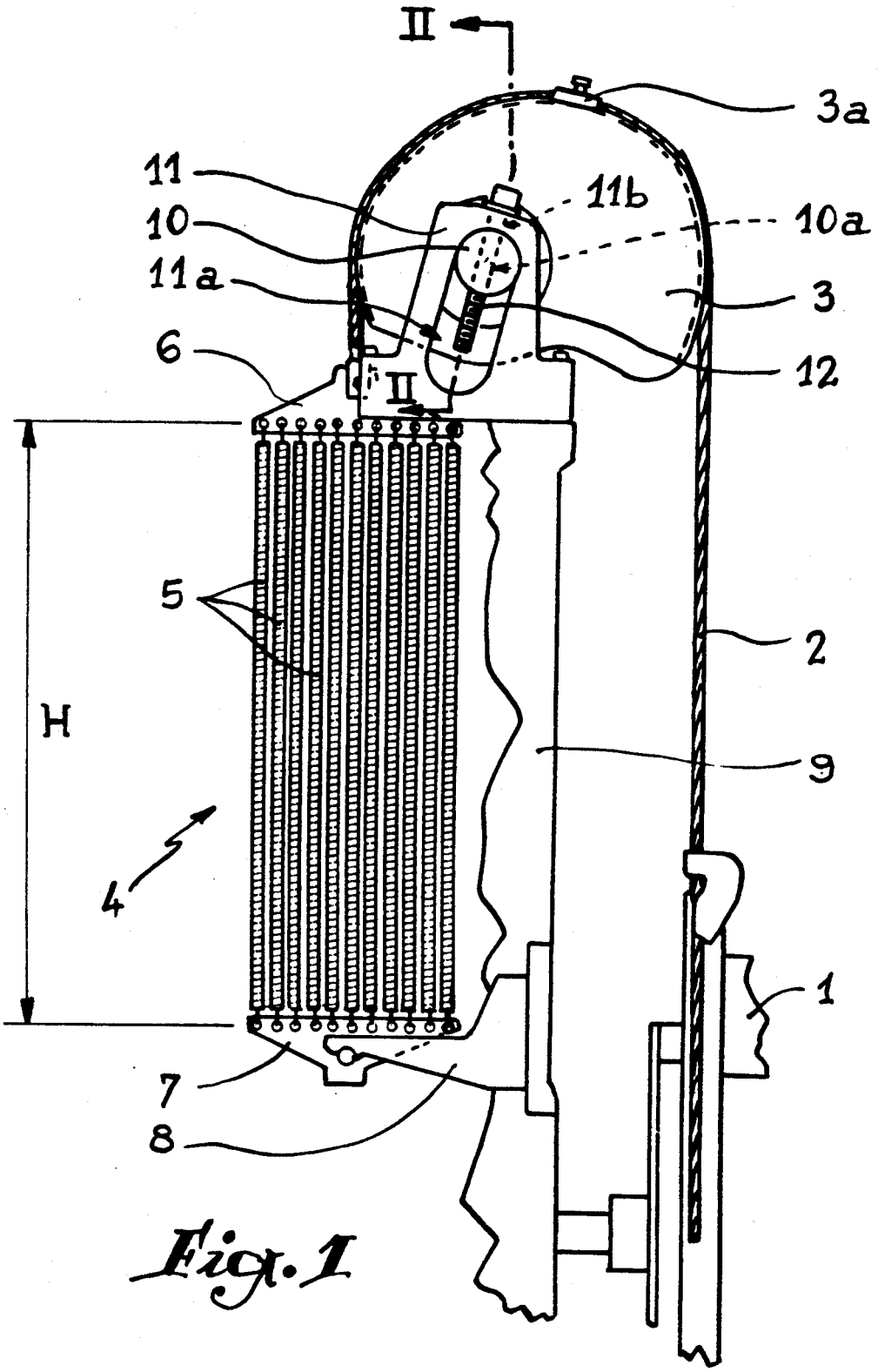
FIG. 1 is a side view of a drawing device according to the present invention.

Referring now to the drawings, reference 1 in FIG. 1 denotes one of the heddle frames mounted on a weaving machine. Each frame 1 is laterally secured to a control cable 2 of which one end is fastened to one of the members for maneuvring the weaving mechanism, while the opposite end is guided over one of a series of rocking levers 3 before being fixed to a spring system 4. Each system 4 conventionally includes a series of vertical springs 5 which are hooked to an upper hooking element 6 secured to the end of the cable 2 below the corresponding lever 3, and to a lower hooking element 7 retained in place by a rack 8 secured to a vertical structure 9 of the weaving machine.

The assembly of the levers 3, in a number equal to that of the heddle frames 1 of the weaving machine, is mounted to oscillate on a horizontal shaft 10 of cross section so that the levers 3, attached to the cables 2 by fastening elements such as **3*a***, may freely rotate on the shaft.

Figure 2:
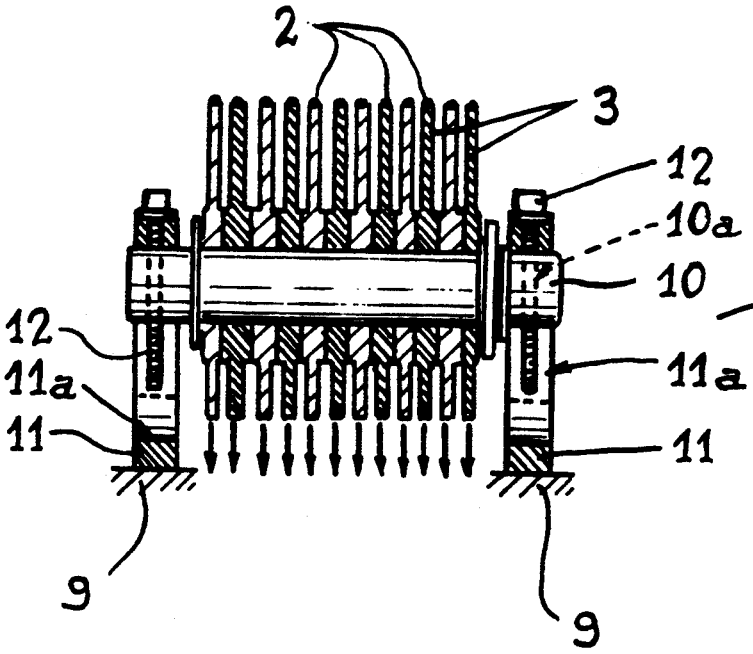
FIG. 2 is a vertical section along the plane indicated at II—II in FIG. 1.
Figure 3:
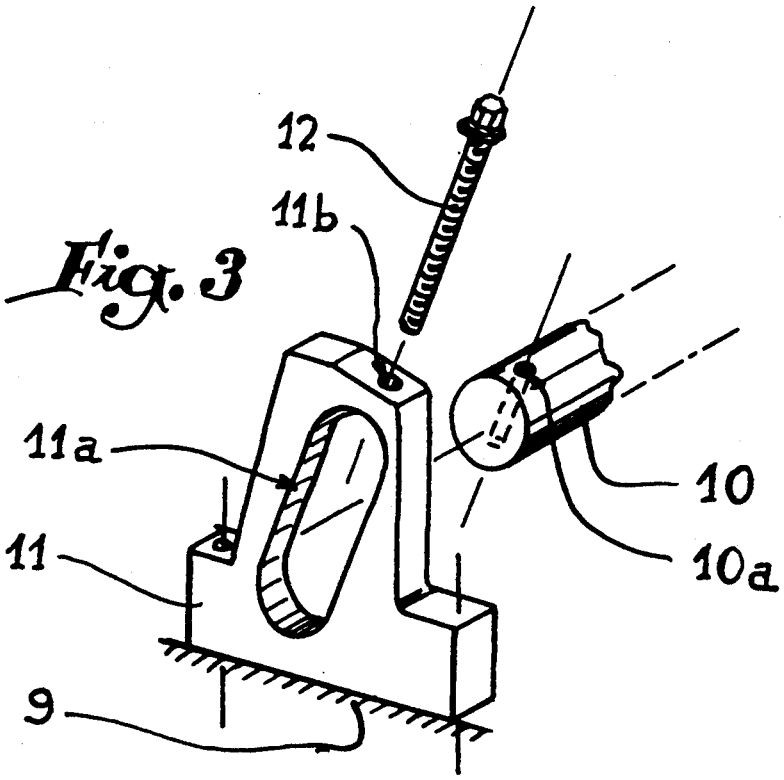
FIG. 3 illustrates in perspective the arrangement of one of the two flanges ensuring adjustable retention of the shaft which supports the oscillating levers.

According to the invention, the shaft 10 is supported by the two vertical structures 9 of the weaving machine via two vertical flanges 11, mounted to the top of the structures in the manner illustrated in FIG. 2. Each flange 11 has an elongated slot **11*a* cut therein, whose longitudinal axis is oriented obliquely with respect to the vertical axis of the frame 2, as shown in FIG. 3. The slot 11*a* is of a width such that it forms a slideway for the corresponding end of the shaft 10** which traverses it.

For the displacement of the shaft 10 in the slots or slideways **11*a* along the longitudinal axis thereof, a screw 12 is employed through each flange 11, which passes through a perforation 11*b* provided therein and along the axis of the slot 11*a*, and which is screwed into a tapping 10*a* made diametrally in each of the ends of the shaft 10, as clearly illustrated in FIG. 3**.

When the weaving machine is functioning, the support shaft 10 of the rocking levers 3 is located in the upper position inside the slideways **11*a*, in the manner shown in FIG. 1. In this position, the upper hooking element 6 is spaced by a distance H from the fixed lower hooking element 7, with the result that the springs 5 of the assembly of spring systems 4 are in tension and therefore perform their function. The lowering of the frames 1 under the effect of the positive control exerted by the cables 2 generates an overtension of the spring systems 4** which resiliently return the frames into their upper position as soon as the members maneuvring the mechanism cease their positive movement.

Figure 4:
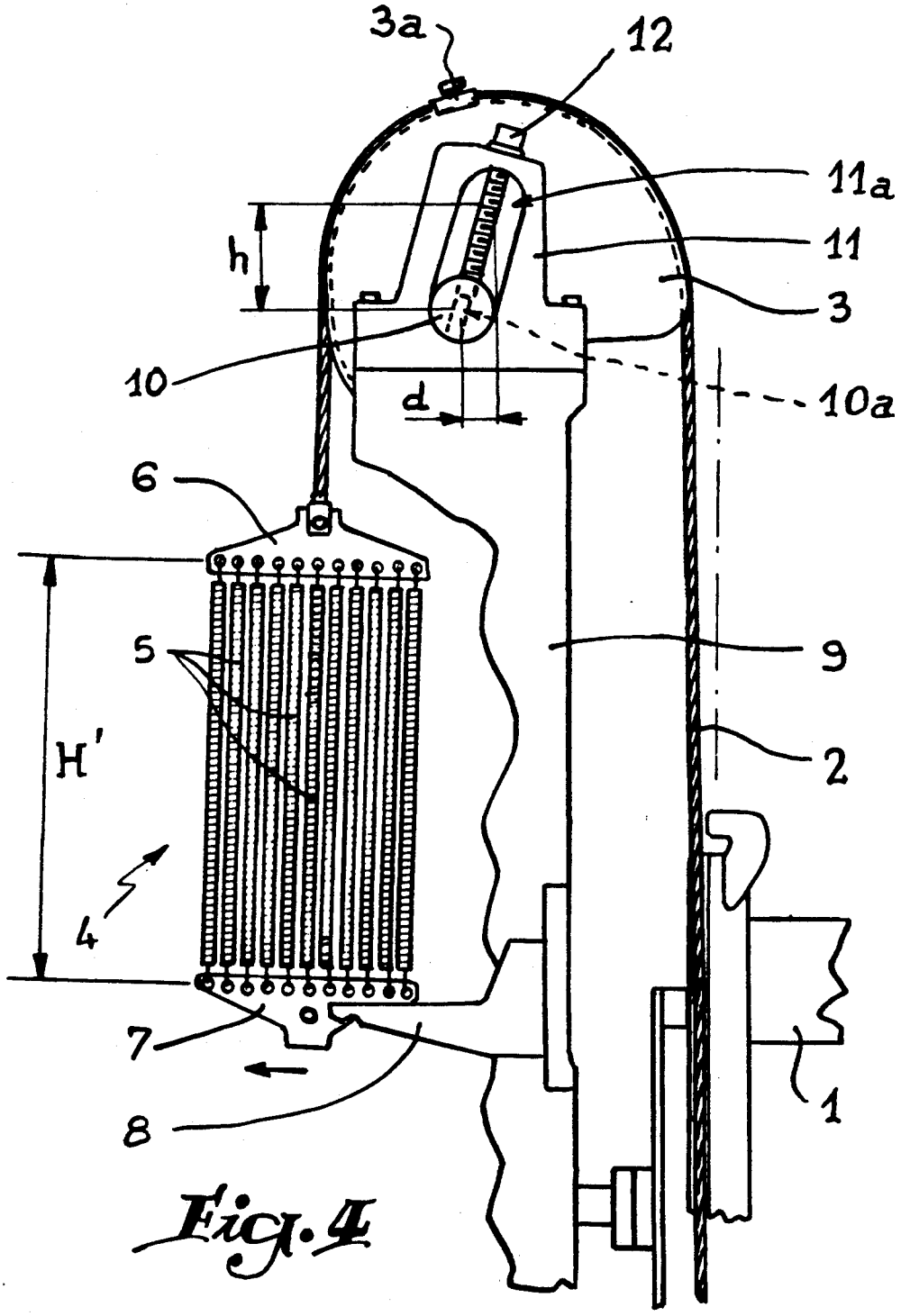
FIG. 4 reproduces FIG. 1 in the relaxed position of the spring systems.

To replace a broken spring 5, or a worn or cut cable, it suffices for the operator to turn the screws 12 carried by the two flanges 11 so as to push shaft 10 downwardly to the lower position illustrated in FIG. 4. It will be appreciated that the lowering of shaft 10 over a distance h provokes the corresponding lowering of the upper hooking element 6 of all the spring systems 4, so that the springs 5 are relaxed to facilitate repair. Once this has been done, the screws 12 are turned to return the support shaft 10 into the upper position for operation.

It should be observed that, due to the oblique orientation of the longitudinal axis of the slots or slideways 11*a*, the lowering of the shaft 10 is accompanied by a horizontal displacement of value d, which shifts that portion of cables 2 included between the fastening thereof on the side of the heddle frames 1 and the rocking levers toward the structure 9. The cables 2, therefore move away from the frames 1 to thus facilitate extraction and positioning thereof.

Figure 5:
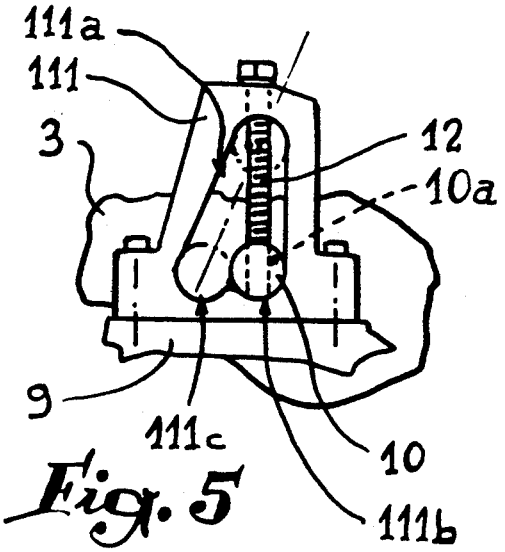
FIG. 5 illustrates another embodiment of the slideway.

When this systematic horizontal displacement of the cables 2 due to the oblique incline of the slideways 11*a* risks proving a hindrance, the variation illustrated in FIG. 5 may be employed. In the case shown each flange 111 has a slideway 111*a* hollowed out therein of substantially triangular configuration, whose base includes two recesses 111*b* and 111*c* which are sectioned to receive selectively the corresponding end of the shaft 10 engaged inside the slideway.

The adjustment of the screw 12 simultaneously associated with each flange 111 and the shaft 10 makes it possible to lower the shaft until it is brought into recess 111*b*. The vertical displacement of shaft 10 ensures relaxation of spring systems 4 and cables 2, without the orientation of these cables being affected. On the contrary, for dismantling the frames 1, the operator transfers each of the ends of the shaft 10 of the two recesses 111*b* to the two recesses 111*c*, which has for its effect to space the cables 2 from frames 1.

It goes without saying that, in such a case, the opening made in the top of each flange 111 must be sectioned to allow the change in the orientation of the screw 12.

Figure 6:
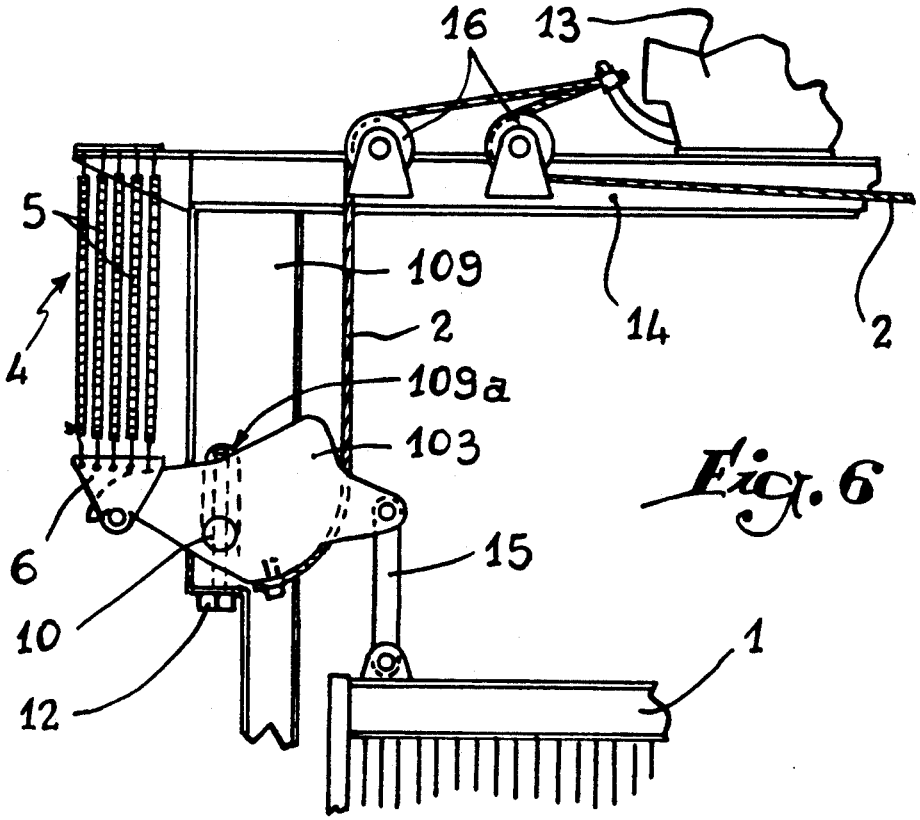
FIG. 6 shows the application of the invention of weaving mechanisms which are mounted in superstructure above the heddle frames.

FIG. 6 illustrates the application of the invention to weaving machines in which the weaving mechanism 13 is supported by a fixed superstructure 14. The two cables 2 associated with each member 13*a* for moving the mechanism 13 to control the corresponding heddle frame 1, are guided and wound over two levers 103 connected to the frame 1 by connecting rods 15 and to the superstructure 14 by spring systems 4.

As in the embodiment according to FIG. 1, each lateral assembly of levers 103 is carried by the same horizontal shaft 10. The ends of the shaft are engaged in slots or slideways 109*a* which may be directly made in the vertical structure 109. With each end of the shaft is associated a screw 12 whose head abuts the edge of an opening made in the structure 109.

In the case shown in FIG. 6, that portion of cable 2 included between the corresponding lever 103 and the upper guide pulley 16 is oriented vertically, like the axis of spring system 4. Each slideway 109*a* is oriented substantially vertically so that the lowering of the shaft 10 and the levers 103 during the manoeuvring of the screws 12 causes the simultaneous relaxing of the springs of systems 4 and of cables 2.

Figure 7:
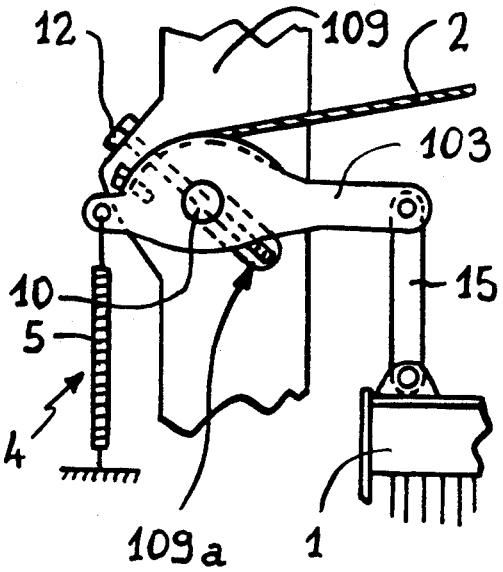
FIG. 7 shows a variant of FIG. 6.

In the embodiment shown in FIG. 7, the axis of the end portion of each cable 2 defines an obtuse angle with the vertical axis of the corresponding spring system 4. In such case, the simultaneous relaxing of the spring systems 4 and of the cables 2 causes the axis of slots or slideways 109*a* to be oriented along the bisectrix of such angle.

It goes without saying that, in all cases, means other than screws 12 may be imagined for ensuring displacement and immobilization of the support shaft 10 with respect to the spring systems 4 of the drawing device. In particular, small hydraulic jacks may be employed.

Furthermore, it will be observed that the invention may be advantageously applied to dobbies or other weaving mechanisms of the negative type in which the drawing device associated with each heddle frame includes only a single cable arranged so as to cause the actuation of the two rocking levers provided for moving a frame. See, for instance U.S. patent application Ser. No. 07/913,952 filed Jul. 17, 1992 by the present Applicants.

What is claimed is:

1. In a weaving machine including a drawing device for actuation of heddle frames of weaving mechanisms of the negative type which includes for each frame at least one control cable which extends from the frame over a lever mounted to oscillate on a support shaft carried by fixed structures of the weaving mechanism to a spring system which is normally under tension, the improvement comprising, the support shaft being guided inside spaced guide slots, adjustment means extending into said guide slots, said support shaft being displaceable along said guide slots by said adjustment means to thereby release tension on the spring systems.

2. The combination of claim 1 in which said guide slots have upper and lower ends, said guide slots being inclined outwardly relative to the heddle frame from said upper toward said lower end thereof, whereby as said adjustment means displaces the support shaft toward said lower ends of said guide slots, the cable will be shifted away from the heddle frames.

3. The combination of claim 2 in which said guide slots are provided in flanges mounted to the fixed structures, first openings in each of said flanges and second openings in the support shaft, and a threaded fastener extending through said first openings in said flanges and into said second openings in the support shaft.

4. The combination of claim 1 in which said guide slots are provided in flanges mounted to the fixed structures, first openings in each of said flanges and second openings in the support shaft, and a threaded fastener extending through said first openings in said flanges and into said second openings in the support shaft.

5. The combination of claim 1 in which said spaced guide slots are generally triangular in configuration having upper and lower portions, said lower portions having first and second adjacent recesses formed therein in which the support shaft is selectively seated.

6. The combination of claim 5 wherein said second recesses are spaced outwardly at a greater distance from the heddle frame than said first recesses.

7. The combination of claim 6 in which said guide slots are provided in flanges mounted to the fixed structures, first openings in each of said flanges and second openings in the support shaft, and a threaded fastener extending through said first openings in said flanges and into said second openings in the support shaft.

8. In a weaving machine including a drawing device for actuation of heddle frames of weaving mechanisms of the negative type which include for each frame a spring system which is normally under tension and means for connecting the spring system to the frame and wherein the means for connecting the spring system includes a rocking lever mounted to a support shaft carried by fixed structures of the weaving machine, the improvement comprising, the support shaft being guided inside spaced guide slots formed within said fixed structures, adjustment means extending into said guide slots, the support shaft being displaceable along said guide slots by said adjustment means to thereby release tension on the spring system.

9. The combination of claim 8 in which said guide slots have upper and lower ends, said guide slots being inclined outwardly relative to the heddle frame from said lower toward said upper end thereof.

* * * * *